US005993321A

United States Patent [19]

Recknagel

[11] Patent Number: 5,993,321

[45] Date of Patent: Nov. 30, 1999

[54] BOWLING LANE DIVISION CAPPING

[75] Inventor: Troy A. Recknagel, Muskegon, Mich.

[73] Assignee: Brunswick Bowling & Billiards Corporation, Muskegon, Mich.

[21] Appl. No.: 09/004,204

[22] Filed: Jan. 8, 1998

[51] Int. Cl.[6] ..... A63D 5/00; E04F 19/02

[52] U.S. Cl. ..... 473/54; 473/113; 52/718.04; 52/716.01

[58] Field of Search ..... 473/54, 113, 115; 52/716.1, 718.01, 718.04, 718.05, 718.06, 718.07, 718.02, 718.03, 717.03; 428/100

[56] References Cited

U.S. PATENT DOCUMENTS

| | | | |
|---|---|---|---|
| 2,134,393 | 10/1938 | Bennett . | |
| 2,241,783 | 5/1941 | Kennedy . | |
| 2,949,303 | 8/1960 | Sherman | 473/113 |
| 3,279,795 | 10/1966 | Larson | 473/113 |
| 4,196,552 | 4/1980 | Bartlett . | |
| 4,946,727 | 8/1990 | Kessler . | |
| 5,222,343 | 6/1993 | Anderson . | |
| 5,242,734 | 9/1993 | Rubin . | |
| 5,353,571 | 10/1994 | Berdan et al. . | |

*Primary Examiner*—William M. Pierce
*Attorney, Agent, or Firm*—Price, Heneveld, Cooper, DeWitt and Litton

[57] ABSTRACT

A bowling lane division capping assembly for attachment atop a division support, comprising an elongated lower member and an elongated upper cap member, the lower member comprising a bottom wall for attachment to the division support, a pair of side walls upstanding from said bottom wall, and the side walls having a pair of upper flanges protruding toward each other while defining a space of predetermined width therebetween allowing access to the bottom wall for insertion of fasteners, the upper cap member comprising an upper wall and a pair of spaced legs depending therefrom, the legs being spaced apart an amount about equal to the space width and having laterally outwardly offset detents spaced apart greater than the space width for engagement beneath the flanges to fasten the upper cap member to the lower member. A pair of elongated gutters astraddle the division support member each have an edge portion on the division support member, the elongated lower member being interfitted with the gutter edge portions.

9 Claims, 2 Drawing Sheets

BOWLING LANE DIVISION CAPPING

BACKGROUND OF THE INVENTION

This invention relates to division capping for bowling lanes in bowling entertainment centers. Bowling entertainment centers provide a plurality of adjacent bowling lanes, each having a pair of lane straddling gutters, as is well known. Between adjacent gutters of adjacent lanes is a separation wall known as a division. The division commonly has a dress capping such as that shown, for example, in U.S. Pat. Nos. 4,801,143 and Design 301,909. The inventor herein determined that bowling lane division capping was needed allowing access to the interior thereof, yet having readily assembled components which can be disassembled when necessary.

SUMMARY OF THE INVENTION

An object of this invention is to provide a novel bowling lane division capping formed of an extruded lower support and an extruded upper cap member which interfit with each other, can provide contrasting colors, provide quick and easy assembly thereof, as well as ready disassembly of the cap element from the base for insertion or removal of additional components such as lights or the like.

Another object of this invention is to provide such a division capping assembly enabling a translucent or transparent upper cap to be employed through which lights within the assembly are viewable, enabling the length of the bowling lanes to be highly colorful and attractive.

The novel division capping is formed of an elongated extruded lower member, preferably of polymeric material, which is fastened to the anchor member beneath it, and an elongated extruded upper cap member of polymeric material. The lower member has a bottom wall interfitted with and fastened to the division member, a pair of spaced upstanding walls integral with the bottom wall, and a pair of top flanges protruding generally toward each other and defining an elongated upper space therebetween. The upper cap comprises an upper wall preferably greater in width than the noted space, and a pair of depending spaced legs integral with said top wall, resiliently deformable toward each other, and having laterally outwardly offset detents engageable beneath the noted protruding flanges. The detents have tapered outer faces for engaging and biasing the legs toward each other upon engagement with the noted flanges, for interconnection of the detents beneath the flanges.

These and other objects, advantages and features of the invention will become apparent upon studying the following specification in conjunction with the drawings.

DETAILED DESCRIPTION OF PREFERRED EMBODIMENT

Figures 1, 3:
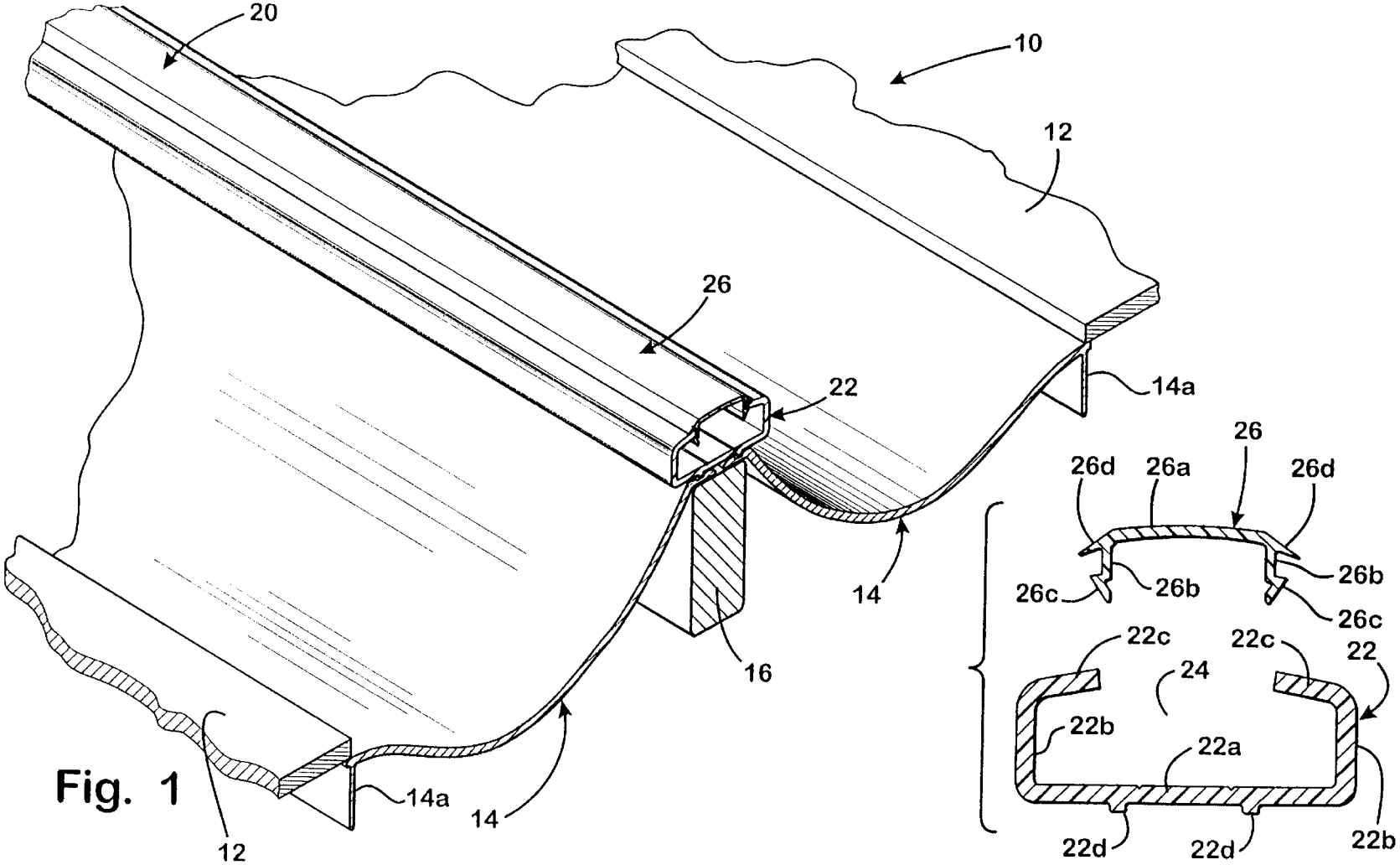
FIG. 1 is a perspective view of the novel division capping assembly shown in combination with a division member and a pair of division straddling gutters for a pair of respective bowling lanes.
FIG. 3 is a sectional elevational exploded view of the two components of the division capping assembly.
Figure 2:
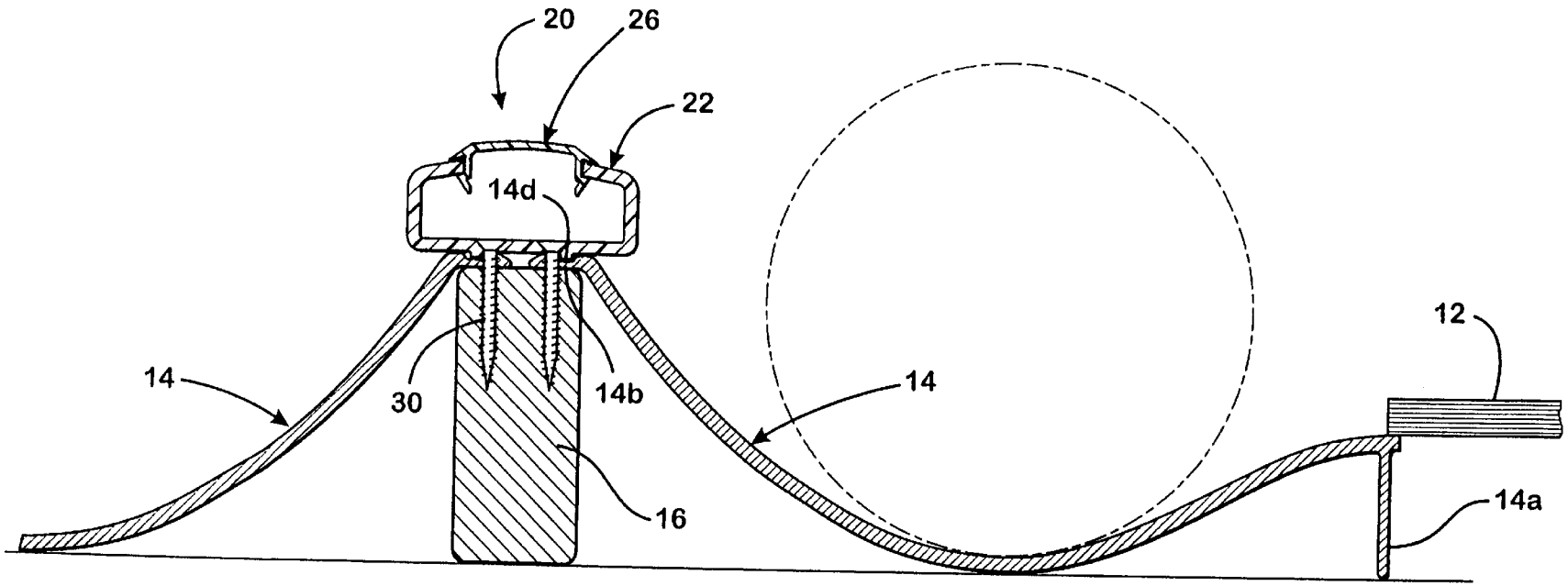
FIG. 2 is a sectional elevational view of a portion of the apparatus in FIG. 1.

Referring now specifically to the drawings, the bowling lane assembly 10 depicted in FIG. 1 includes a pair of conventional bowling lanes 12 spaced from each other. Each lane has a pair of lane straddling gutters such that one gutter 14 of each lane 12 is immediately adjacent the gutter of the next lane, with a division member 16 therebetween. On the opposite side of each of the two lanes 12 depicted in FIG. 1 is the second gutter (not shown) which is adjacent the bail return, in conventional manner. The present invention pertains particularly to the division capping assembly 20 and its interrelationship with the gutter elements 14 and division member 16.

Gutter elements 14 are elongated members running the length of the lanes, having a concave upper surface to receive balls which depart from the lane and ultimately roll into the pit. The gutter elements 14 can be formed of suitable material including metal or polymer, i.e., plastic. Preferably the elements have an upstanding support leg 14*a* adjacent lane 12 and a support flange 14*b* on the opposite edge of the gutter resting on division member 16. Flange 14*b* is interengaged with the lower member 22 of assembly 20, with both member 22 and the gutters being secured to division member 16 by threaded fasteners such as screws 30, as will be explained.

Lower member 22 is preferably an elongated extrusion element which runs the length of the bowling lane, preferably in segments thereof. This lower member has a lower, i.e., bottom, wall 22*a*, a pair of side walls 22*b* which extend integrally up from lower wall 22*a*, and a pair of upper flanges 22*c* which extend integrally from the upper ends of walls 22*b* generally toward each other but defining an open elongated space 24 therebetween. The side walls and flanges may be one continuous curve instead of extending upwardly and then inwardly. Protruding from the bottom of lower wall 22*a* are a pair of protrusion ribs 22*d* for engaging recess grooves in the respective adjacent edge portions of gutters 14. Alternatively, the recess grooves can be in member 22 and the protrusion ribs in flanges 22*c*.

The upper cap member 26 of assembly 20 comprises an upper wall 26*a* and a pair of spaced legs 26*b* depending downwardly from upper wall 26*a*. The cap may be in segments for easy handling and assembly. The legs 26*b* are spaced apart an amount about equal to the width of space 24, and have laterally outwardly offset detents 26*c* extending in opposite directions. The lower portions of these detents are sloped upwardly outwardly for engagement with flanges 22*c* whereby downward force applied to cap member 26 causes legs 26*b* to be shifted inwardly by flanges 22*c* against the inherent bias of the legs until detents 26*c* engage beneath the bottom surfaces of flanges 22*c*. The presently preferred polymer for the base member and the cap member is rigid polyvinylchloride (PVC) but could be a polyester or any other suitable polymer. The outer edges of upper wall 26*a* of cap 26 preferably have downwardly outwardly sloped tapered flanges 26*d* which are resiliently upwardly deformable slightly as detents 26*c* snap beneath flanges 22*c* for tight securement. Cap 26 can be opaque and of the same or a different contrasting color than lower member 22 for aesthetic contrast. Alternatively, cap member 26 can be translucent or transparent such that output from spaced lights located within the hollow assembly 20 will be viewable along the length of the bowling lanes to provide highly colorful effects. Conceivably, said lower member can be translucent or transparent.

In assembling the bowling lane gutters, divider member 16 and bowling lane division capping assembly, the outer edge portions of gutters 14 (with respect to the lanes) are placed on the upper surface of upright member 16 with the inner edge portion of the gutters being supported by depending legs 14*a*. Lower member 22 is placed on these outer edge portions such that ribs 22*d* are fitted within correspondingly configured grooves 14*c* in the upper surfaces of the gutter edge portions. Then fasteners 30 are advanced through lower member 22, gutter edge portions 14*b* and into upright divider 16 which is typically made of wood, polymer or the equivalent, to anchor these components in place. Access to the upper ends of fasteners 30 is readily made through space 24 of lower member 22. If wiring, lighting or the like is to be inserted into the capping assembly, this is readily done. Cap 26 is aligned with space 24 and pressed down such that the tapered lower surfaces of detents 26*c* on legs 26*b* engage the inner edges of flanges 22*c*. Downward pressure on the cap member causes flanges 22*c* to shift legs 26*b* and detents 26*c* inwardly toward each other until the detents are beneath flanges 22*c* at which time the inherent bias of the legs causes the detents to engage beneath flanges 22*c* to retain the assembly together. Alternatively, the cap can be inserted or removed from the lower member by lengthwise movement of the cap. The assembly prevents access to the interior of the division capping assembly by unauthorized personnel. Yet the cap 26 can be removed from lower member 22 if necessary by forcing legs 26*b* inwardly toward each other at one end of the elongated member and then lifting the cap from the base member, or by sliding it out lengthwise.

The above description is considered that of the preferred embodiment only. Modifications of the invention will occur to those skilled in the art and to those who make or use the invention. Therefore, it is understood that the embodiment shown in the drawings and described above is merely for illustrative purposes and not intended to limit the scope of the invention, which is defined by the following claims as interpreted according to the principles of patent law, including the doctrine of equivalents.

I claim:

1. A bowling lane division and gutter assembly comprising:

an elongated division support member;

a pair of elongated gutters astraddle said division support member, each having an edge portion on said division support member;

a division capping assembly comprising an elongated lower member and an elongated upper cap member;

a plurality of fasteners;

a plurality of fasteners;

said elongated lower member being interfitted with said gutter edge portions, and having walls defining an upper space enabling said fasteners to be inserted through said lower member and said edge portions into said division support member; and said upper cap member being interfitted with said lower member at said space to enclose said division capping assembly.

2. The bowling lane division and gutter assembly of claim 1 wherein said elongated lower member and said gutter edge portions are interfitted with protrusions and recesses.

3. The bowling lane division and gutter assembly of claim 2 wherein said protrusions are ribs and said recesses are grooves.

4. The bowling lane division and gutter assembly of claim 3 wherein said ribs are on said lower member and said grooves are in said gutter edge portions.

5. The bowling lane division and gutter assembly of claim 1 wherein said lower member comprises a bottom wall for attachment to the division support, a pair of side walls upstanding from said bottom wall, and said side walls having a pair of upper flanges protruding toward each other while defining a space of predetermined width therebetween allowing access to said bottom wall for insertion of said fasteners;

said upper cap member comprising an upper wall and a pair of spaced legs depending therefrom, said legs being spaced apart an amount about equal to said space width and having laterally outwardly offset detents spaced apart greater than said space width for engagement beneath said flanges to fasten said upper cap member to said lower member.

6. The division capping assembly in claim 5 wherein said legs are resiliently biased to said spaced apart amount and are temporarily resiliently shiftable to fit between said flanges.

7. The division capping assembly in claim 6 wherein said detents have downwardly inwardly sloped outer surfaces engageable with said flanges for shifting said legs.

8. The division capping assembly in claim 1 wherein said upper cap member is of translucent or transparent polymer.

9. The division capping assembly in claim 1 wherein said lower member is of opaque polymer.

* * * * *

UNITED STATES PATENT AND TRADEMARK OFFICE

CERTIFICATE OF CORRECTION

PATENT NO. : 5,993,321
DATED : November 30, 1999
INVENTOR(S) : Troy A. Recknagel It is certified that error appears in the above-identified patent and that said Letters Patent is hereby corrected as shown below:

Column 3, line 46, delete "a plurality of fasteners;".

Signed and Sealed this

Seventh Day of November, 2000

*Attest:*

Q. TODD DICKINSON

*Attesting Officer*

*Director of Patents and Trademarks*